US008438792B2

(12) United States Patent
Schwartz

(10) Patent No.: US 8,438,792 B2
(45) Date of Patent: May 14, 2013

(54) RIGID INSULATION PRODUCT

(76) Inventor: Joel A. Schwartz, Danville, VT (US)

( * ) Notice: Subject to any disclaimer, the term of this patent is extended or adjusted under 35 U.S.C. 154(b) by 2938 days.

(21) Appl. No.: 10/798,682

(22) Filed: Mar. 11, 2004

(65) Prior Publication Data

US 2005/0210827 A1 Sep. 29, 2005

(51) Int. Cl.
*E04B 7/04* (2006.01)

(52) U.S. Cl.
USPC ..... 52/92.2; 52/404.1; 52/653.1

(58) Field of Classification Search ..... 52/633, 52/763, 404.1, 653.1, 406.2, 506.01, 702, 52/241, 92.2, 309.8, 404.4, 407.3, 506.03
See application file for complete search history.

(56) References Cited

U.S. PATENT DOCUMENTS

| | | | | |
|---|---|---|---|---|
| 2,094,635 | A | 10/1937 | Brooks | 20/4 |
| 2,128,549 | A | 8/1938 | Zier et al. | 20/4 |
| 2,172,048 | A | 9/1939 | Johnson | 20/4 |
| 2,312,987 | A | 3/1943 | Grassick | 154/45 |
| 2,816,623 | A | 12/1957 | Wong | 183/36 |
| 3,093,218 | A | 6/1963 | Peterson | 189/34 |
| 3,258,889 | A | 7/1966 | Butcher | 52/309 |
| 3,619,437 | A | 11/1971 | McDonald, Jr. | 264/45 |
| 3,641,724 | A | 2/1972 | Palmer | 52/615 |
| 4,170,859 | A | 10/1979 | Counihan | 52/763 |
| 4,843,774 | A | 7/1989 | Korsgaard | 52/408 |
| 4,967,529 | A * | 11/1990 | L'Heureux | 52/390 |
| 5,113,631 | A | 5/1992 | diGirolamo et al. | 52/236.8 |
| 5,511,346 | A | 4/1996 | Kenworthy | 52/169.5 |
| 5,765,330 | A | 6/1998 | Richard | 52/309.13 |
| 5,829,215 | A | 11/1998 | Billing | 52/309.4 |
| 5,966,894 | A | 10/1999 | Crump, Jr. | 52/729.4 |
| 6,042,911 | A * | 3/2000 | Berdan, II | 428/36.3 |
| 6,125,608 | A * | 10/2000 | Charlson | 52/733.2 |
| 6,226,943 | B1 * | 5/2001 | Grinshpun et al. | 52/309.4 |
| 6,349,520 | B2 * | 2/2002 | Kubica | 52/426 |
| 6,418,682 | B1 * | 7/2002 | Rice | 52/241 |
| 6,427,413 | B1 * | 8/2002 | Lafrance | 52/578 |
| 6,530,180 | B2 * | 3/2003 | Edmondson et al. | 52/105 |
| 6,901,715 | B2 * | 6/2005 | Brown et al. | 52/702 |
| 2002/0020129 | A1 | 2/2002 | Winter | 52/406.1 |
| 2003/0070378 | A1 | 4/2003 | Knapp | 52/483.1 |

* cited by examiner

*Primary Examiner* — Branon Painter
(74) *Attorney, Agent, or Firm* — Fish & Richardson P.C.

(57) ABSTRACT

Rigid insulation products are provided, including a single unitary insulating member having slots for receiving the ends of floor joists. The insulating member may be pre-attached to a wood member, which functions as a joist header, or may be attached to a joist header during construction.

17 Claims, 7 Drawing Sheets

RIGID INSULATION PRODUCT

GOVERNMENT SUPPORT

Partial funding for the work described herein was provided by Northeastern Vermont Development Association through a Rural Business Enterprise Grant from USDA Rural Development.

TECHNICAL FIELD

This invention relates to rigid insulation products for use, e.g., in wood frame construction.

BACKGROUND

In typical wood frame construction, a builder will attach floor joists directly to a joist header (also known as a rim board, header joist, rim joist, rim band or band) with mechanical fasteners such as nails and wood screws. The builder then cuts pieces of fibrous insulation, e.g., glass fiber insulation, or rigid insulation to fit between each joist to insulate the joist header and prevent air infiltration. In some cases, the builder will caulk along the cracks between the rigid insulation, joists and joist header. Occasionally, the builder will spray foam insulation, e.g., a sprayable polyurethane, into these cracks and other spaces where there is no rigid insulation. With the exception of the latter construction practice, the 7" to 13" of wall height at the ends of joists tend to provide poor thermal protection, e.g., due to improperly installed glass fiber insulation that sags, air leakage through the fibers of fibrous insulation, or air leakage around cracks between pieces of rigid insulation and the floor joists where they meet the joist header.

SUMMARY

The rigid insulation products described herein provide builders of wood framed structures, including modular home manufacturers, with a single unitary insulating member, or a pre-insulated joist header, for insulating between floor joists in the construction application discussed above. In one implementation, a rigid insulation product includes a single, unitary insulating member, dimensioned to be attached along the length of a joist header and having a plurality of slots dimensioned to receive the ends of floor joists. In another implementation, the rigid insulation product includes a pre-insulated joist header, i.e., a wood member dimensioned to function as a joist header, and a single, unitary insulating member having slots for receiving floor joists mounted on the wood member. In the latter implementation, because the wood member is pre-attached to the insulating member the builder does not need to perform the additional step of attaching the insulating member to the joist header during construction.

The rigid insulation products discussed above act as an air barrier to prevent or inhibit air infiltration over the tops of foundation walls between floor joists and over the tops of wood framed walls with wood floor joists. The rigid insulation products can be quickly and easily installed without cutting and fitting and without the need for additional steps such as caulking or spraying of foam insulation. The products also provide a guide for installing joists on uniform centers, simplifying construction, reducing errors in measurement and speeding floor joist layout during construction. If desired, the builder can easily cut additional slots for joists that are not on center, e.g., using a hot wire blade or knife.

The rigid insulation products are manufactured in dimensions to match conventional floor framing lumber or pre-engineered manufactured lumber uses as floor joists. The slots are dimensioned to match the dimensions of floor joist ends, and to provide a thermal break between the floor joist ends and the joist header. This "thermal break" reduces heat loss through conduction at the backs of the slots that receive the ends of the joists and reduces conduction from the floor joist through to the joist header.

In one aspect, the invention features a rigid insulation product for use in wood frame construction, comprising a single unitary insulating member, dimensioned to be mounted lengthwise on a joist header and including a plurality of slots extending width-wise across the member, each slot being dimensioned to receive an end of a floor joist.

In another aspect, the invention features a rigid insulation product for use in wood frame construction, including: (a) a single unitary insulating member, including a plurality of slots extending width-wise across the member, each slot being dimensioned to receive an end of a floor joist; and (b) a wood member, dimensioned to function as a joist header in the wood frame construction, mounted on the insulating member.

Some implementations of these aspects of the invention may include one or more of the following features. The slots may be disposed at spaced intervals, the spacing of the slots corresponding to predetermined spacing of the floor joists in the wood frame construction. The member may include a wall, at the base of each slot, of sufficient thickness to provide a thermal break between the floor joist end and the joist header when the product is in use. The width of the insulating member may be substantially equal to the width of the joist header on which the insulating member will be mounted. The slots may extend across the entire width of the insulating member.

In some cases, the rigid insulation product may further include the joist header, which in such cases is pre-attached to the insulating member. The insulating member may include an insulating material selected from the group consisting of cellular polystyrene, polyurethane and isocyanurate, other cellular plastics, cellulose, and mixtures thereof.

In some implementations, at least some of the slots are dimensioned to receive an end of a wood I-beam. The slots may be spaced at intervals of about 16 inches or at intervals of about 24 inches. The wall may have a thickness of at least 0.375 inch. The insulating member may have a thickness, in regions between the slots, of from about 1.0 to 3.5 inches.

The invention also features methods of using the rigid insulation products described herein in wood frame construction.

For example, in one aspect the invention features a method of constructing a floor of a structure, including (a) mounting an insulating member on a joist header, the insulating member including a plurality of slots extending width-wise across the insulating member, each slot being dimensioned to receive an end of a floor joist; (b) inserting the ends of a plurality of floor joists in the slots; and (c) securing the floor joists to the joist header.

The inserting and securing steps may be performed at a construction site, and the mounting step may be performed at the construction site or at a site remote from the construction site. The insulating member may be formed in place on the joist header, e.g., using a process selected from extrusion and molding. Alternative, the insulating member may be adhesively bonded to the joist header. In some preferred implementations, the slots are of sufficient depth to hold the ends of the floor joists in place during the securing step, allowing the insulating member to be used as a template. In some construction applications, at least some of the slots may be dimensioned to receive an end of a joist having an I or C shaped cross-section.

In a further aspect, the invention features a rigid insulation product that includes a single unitary insulating member, dimensioned to be mounted lengthwise on a joist header and including a plurality of slots extending width-wise across the member, each slot being dimensioned to receive an end of a floor joist having a C or I shaped cross-section. The rigid insulation product may in some cases include the joist header, which in such cases is pre-attached to the insulating member.

The details of one or more embodiments of the invention are set forth in the accompanying drawings and the description below. Other features and advantages of the invention will be apparent from the description and drawings, and from the claims.

DETAILED DESCRIPTION

Preferred rigid insulation products of the invention include slots at regular intervals designed to fit over the ends of floor joists in wood frame construction, and are of a length and width selected to match the depths of the floor joists. The width of the slots is selected to match the width of the floor joists.

Figure 1:
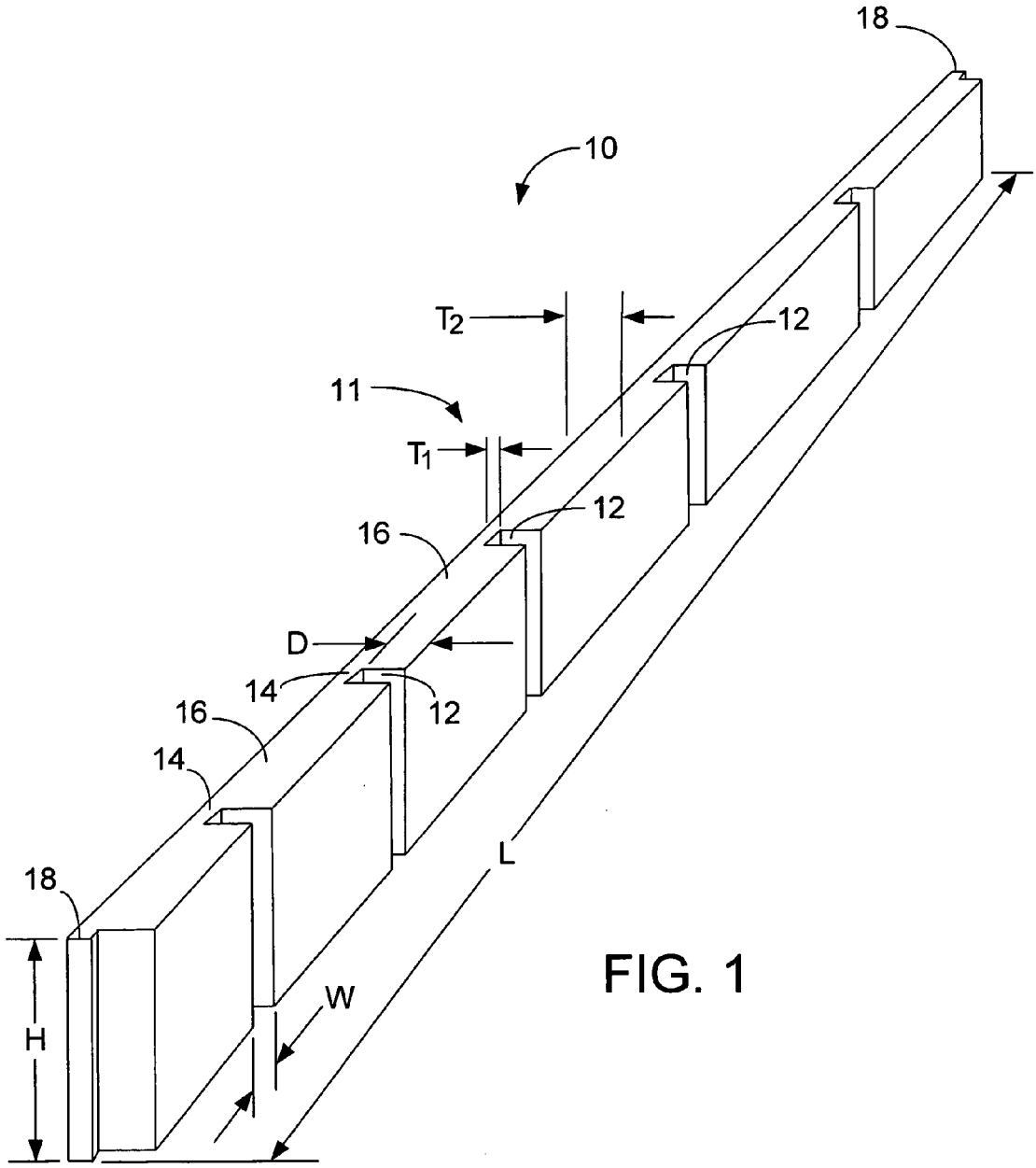
FIG. 1 is a perspective view of a rigid insulation product.

A rigid insulation product 10 is shown in FIG. 1. Rigid insulation product 10 includes an insulating member 11, which is a piece of rigid insulating material having a length L selected to correspond to the length of a joist header to which the insulating member is to be attached. Typically, the insulating member 10 will have a length L from about 4' to 24', with length increasing in 2 foot or 4 foot increments. While it is preferred that the insulating member 11 extends the full length of the joist header, in some cases the insulating member may be shorter. For example, if desired two insulating members could be attached end-to-end along a single joist header.

The insulating member 11 includes a plurality of slots 12, each slot being dimensioned to receive a butt end of a floor joist. If two or more insulating members are attached end-to-end along a single joist header, one or more of the slots may be formed by two adjacent "half-slots" at the end of the abutting insulating members. Preferably, the slots are spaced at intervals of 16" or 24" and have a height H selected to match the width of sawn lumber, e.g., 7.25", 9.25", 11.25" or any other height that will match the width of manufactured wood that is used as joists in wood frame construction. If desired, the insulating member may be slightly higher than the width of the header, e.g., from about 0-2% higher, in which case it will typically be compressed by the underlayment that is placed over the joists, resulting in a tight fit that will resist air leakage.

The number of slots will depend on the number of floor joists used in a particular construction layout; for most residential jobs the insulating member will include at least 7 slots, e.g., the insulating member will typically extend linearly across the ends of at least 6 joists. In most implementations, the insulating member is formed of a material that may be easily slotted or cut on site, to accommodate one or more extra floor joist(s) wherever the builder deems such additional joists necessary for floor strength.

The width W of each slot is selected to match the width of conventional lumber, typically 1.5", or the width of manufactured joists. To insure a snug fit of the joist into the slot, the width of the slot may be slightly less than that of the joist, e.g., by a nominal measurement such 1/16" to 1/32" of an inch, an amount that will be determined based on the compressibility of the material used for insulation.

Each slot 12 includes a back wall 14, having sufficient thickness (T1) to provide a thermal break. Generally, back wall 14 is also strong enough so that it will not break prior to or during attachment of the rigid insulation product 10 to a joist header, i.e., the back wall is sufficiently strong so as to maintain the continuous length of each insulating member. Between the slots, the insulating member has thicker portions 16, each having a thickness (T2) that is selected to provide a desired degree of insulation. T1 and T2 will depend on the level of insulation that is required, cost constraints, and the rigidity, density and R value of the insulation that is used. Generally, T1 will be at least about 0.375", typically about 0.5 to 1.0", and T2 will be at least about 1.375", typically about 1.0 to 3.5". The depth D of the slot (i.e., T2−T1) is preferably at least about 1.0", and is typically in the range of about 1.5 to 3.0 inches. The thickness of the back wall 14 (T1) is generally selected to be the minimum thickness that will provide adequate insulation properties to this thermal break; if the back wall 14 is too thin, thermal properties may be less than desired, while if it is too thick it may be difficult to fasten the joists to the joist header. The depth D of the slot depends primarily on the desired thicknesses of the back wall 14 and the thicker portions 16, which in turn depend, as noted above, on the thermal and structural characteristics of the insulation and manufacturing cost considerations. However, it is generally preferred that depth D be sufficient to allow slots 12 to hold the joist in place during lay-out of the floor, so that the insulating member can serve as a template to assist lay-out.

Suitable insulating materials for use in the insulating member include rigid cellular materials including, but not limited to, cellular plastics such as expanded or extruded polystyrene, polyurethane, and isocyanurate, cellulose, and mixtures thereof. Other suitable materials include other natural or synthetic materials that can maintain the desired shape of the insulating member during installation and use and can offer an effective "R" value to provide a desired level of insulation. Generally, the insulating material will have an R value of at least about 2.5, preferably about 3.5 to 6 per inch of insulation. For some applications, it is preferred that the insulating material provide a degree of moisture resistance. Insulating materials that provide moisture resistance, e.g., urethane insulation and extruded polystyrene, tend to be more expensive than non-moisture-resistant materials, so for cost-sensitive applications and applications in which moisture penetration is not an issue, such materials may not be preferred.

The insulating member may be fabricated from board stock, molded, extruded, or formed into the desired shape using any other suitable technique.

Figure 2:
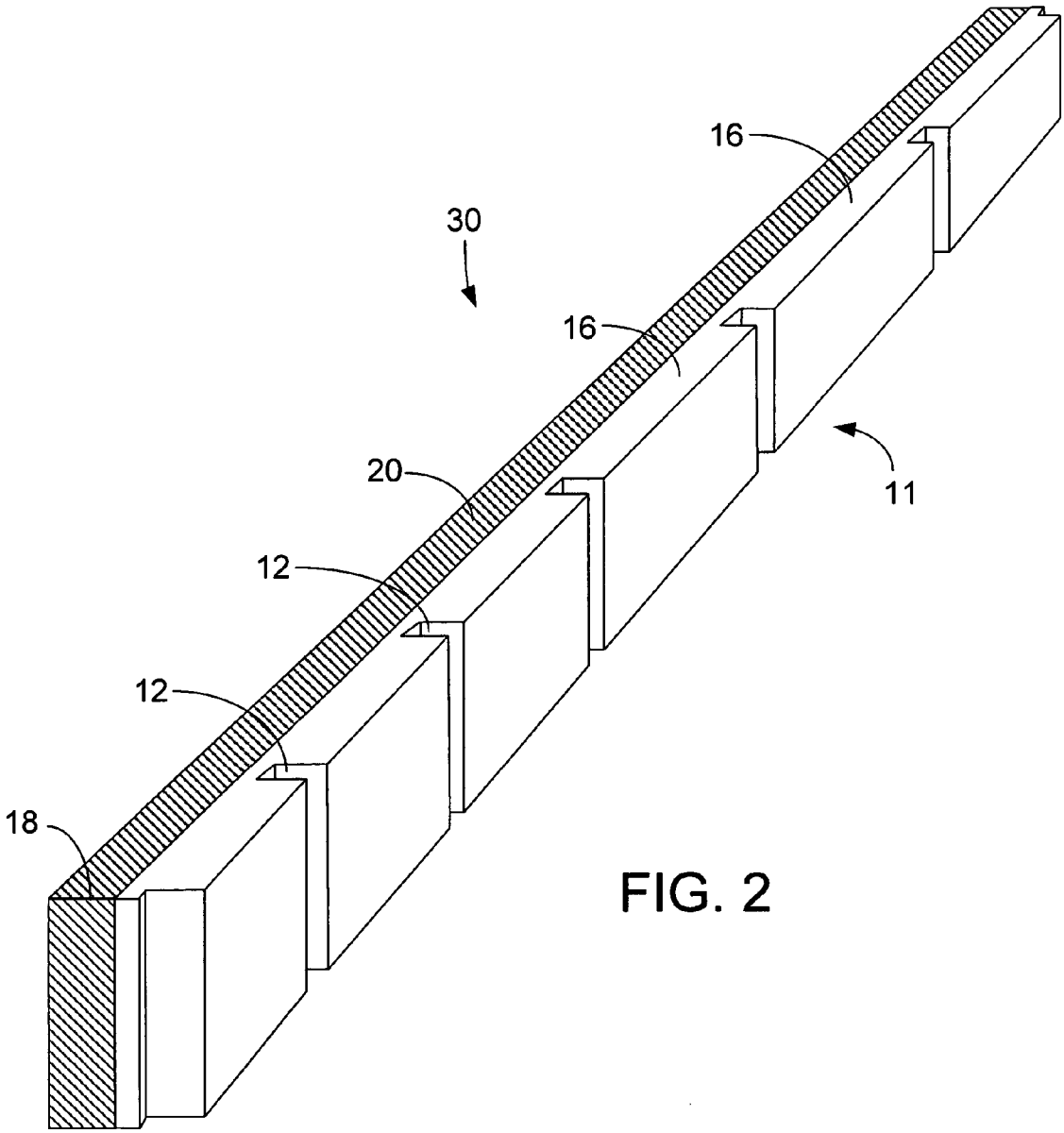
FIG. 2 is a perspective view of an alternative rigid insulation product.

As shown in FIG. 2, an alternative rigid insulation product 30 includes an insulation member 11, as discussed above, pre-mounted on a wood member 20. Wood member 20 may be, for example, a piece of sawn lumber, or any form of laminated veneer lumber, particle board or oriented strand board. The wood member 20 is dimensioned to function as a joist header in a wood frame construction. The insulating member may be joined to the wood member using any type of mechanical bond, for example glue lamination. The insulating member may also be joined to the wood member by a molecular bond, for example resulting from an exothermic reaction during any heat based forming or molding process. If desired, the insulating member may be molded or extruded directly onto the wood member. The minimum thickness of the wood member is generally about 0.75", thereby giving a combined minimum thickness of the insulating member and wood member of about 2.125." The length and width of the wood member are generally substantially the same as the length and width of the insulating member, as shown in FIG. 2.

The edge where the insulating member and wood member meet may be a straight edge, as shown in FIGS. 1 and 2. Alternatively, the edge may be a half-lap over the joist, an extended half-lap that laps over the insulation of the adjacent piece, or a tongue and groove joint (not shown). The end detail of each insulating member (end portion 18 in FIGS. 1 and 2) may be designed with a full slot at one end and no slot at the other end to maintain on-center joist layouts, or may be a "half-lap" slot at both ends so that insulation pieces meet at the butt end of a joist.

Example

Figure 5:
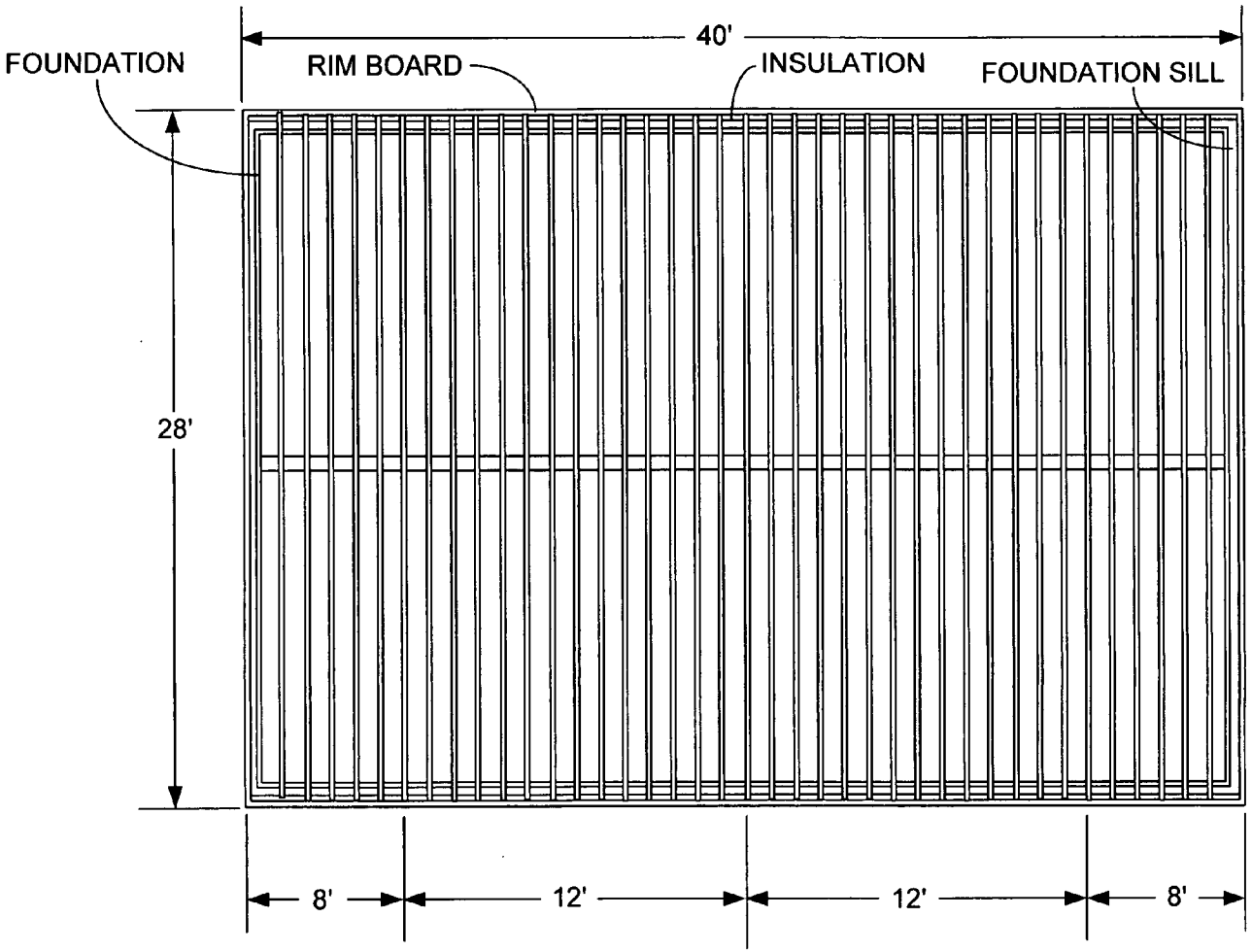
FIG. 5 is a framing plan for the house described in the Example.

Referring to FIG. 5, a typical 28'×40' ranch home on frost walls or full foundation would have a floor frame of 2×10's 16" on center spanning 14' to a center beam with a floor deck of ¾" plywood underlayment. Rigid insulation products that would accommodate this floor diaphragm would be, along the 40' long dimension of the floor, two 12' and two 8' long joist headers with insulating members attached. The insulating members would be cellular polystyrene with slots having the following dimensions: W=1.5", D=1.5", T1=0.5", T2=2.0". The insulating members and joist headers would be 9.25" in width to accommodate the ends of each floor joist.

A number of embodiments of the invention have been described. Nevertheless, it will be understood that various modifications may be made without departing from the spirit and scope of the invention.

Figure 3:
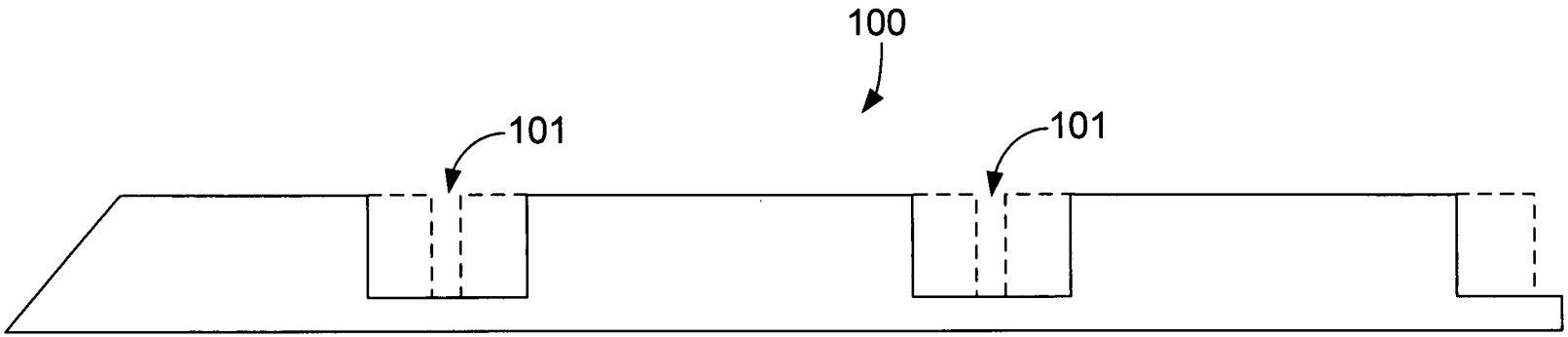
FIG. 3 is a front plan view of another alternative rigid insulation product.
Figure 4:
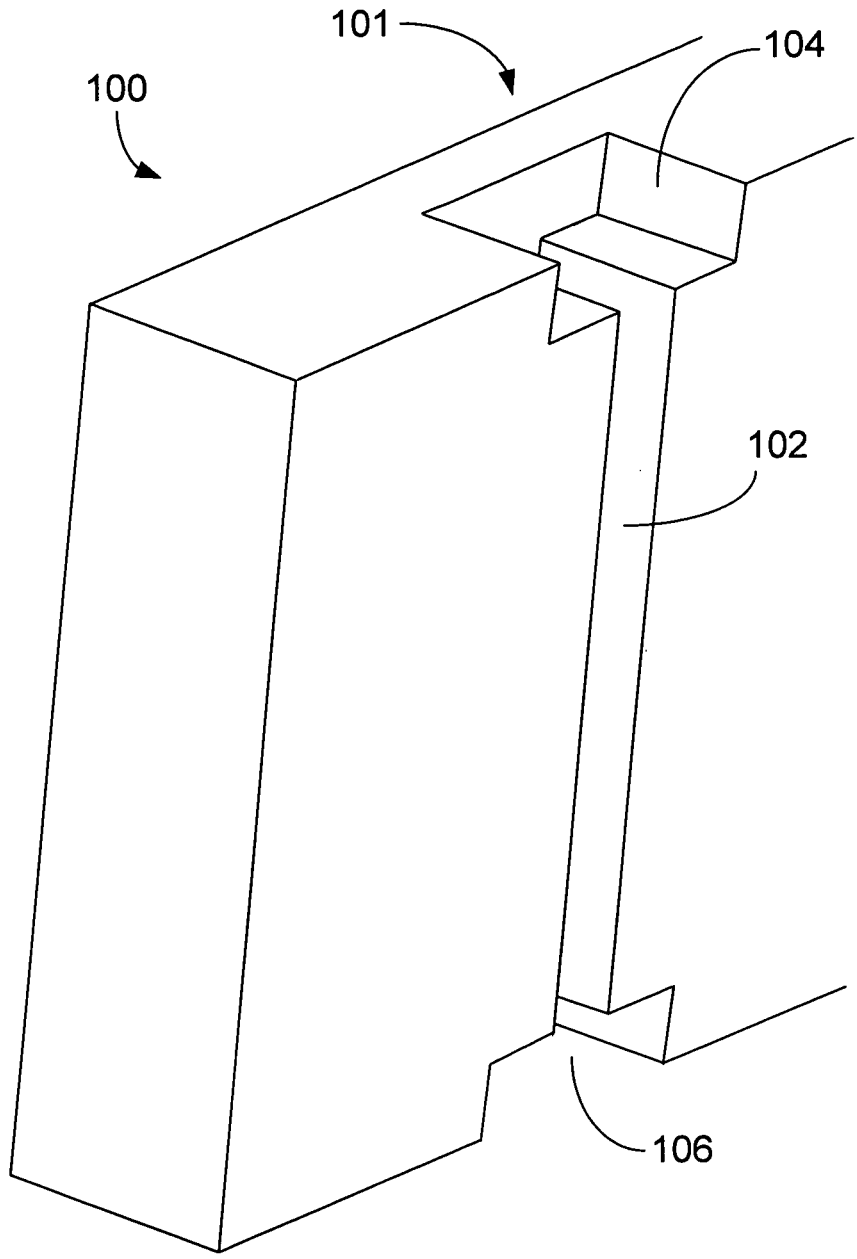
FIG. 4 is an enlarged perspective view of one of the slots 101 shown in FIG. 3.

For example, the slots may be configured to receive floor joists having different shapes and sizes. In one implementation, shown in FIGS. 3 and 4, the slots in the insulating member are configured to receive the ends of I-beam shaped floor joists. Thus, each slot 101 of insulating member 100 includes a vertical portion 102 and two horizontal end portions 104, 106. The floor joists could have other shapes, e.g., a C-shaped configuration.

Figure 6:
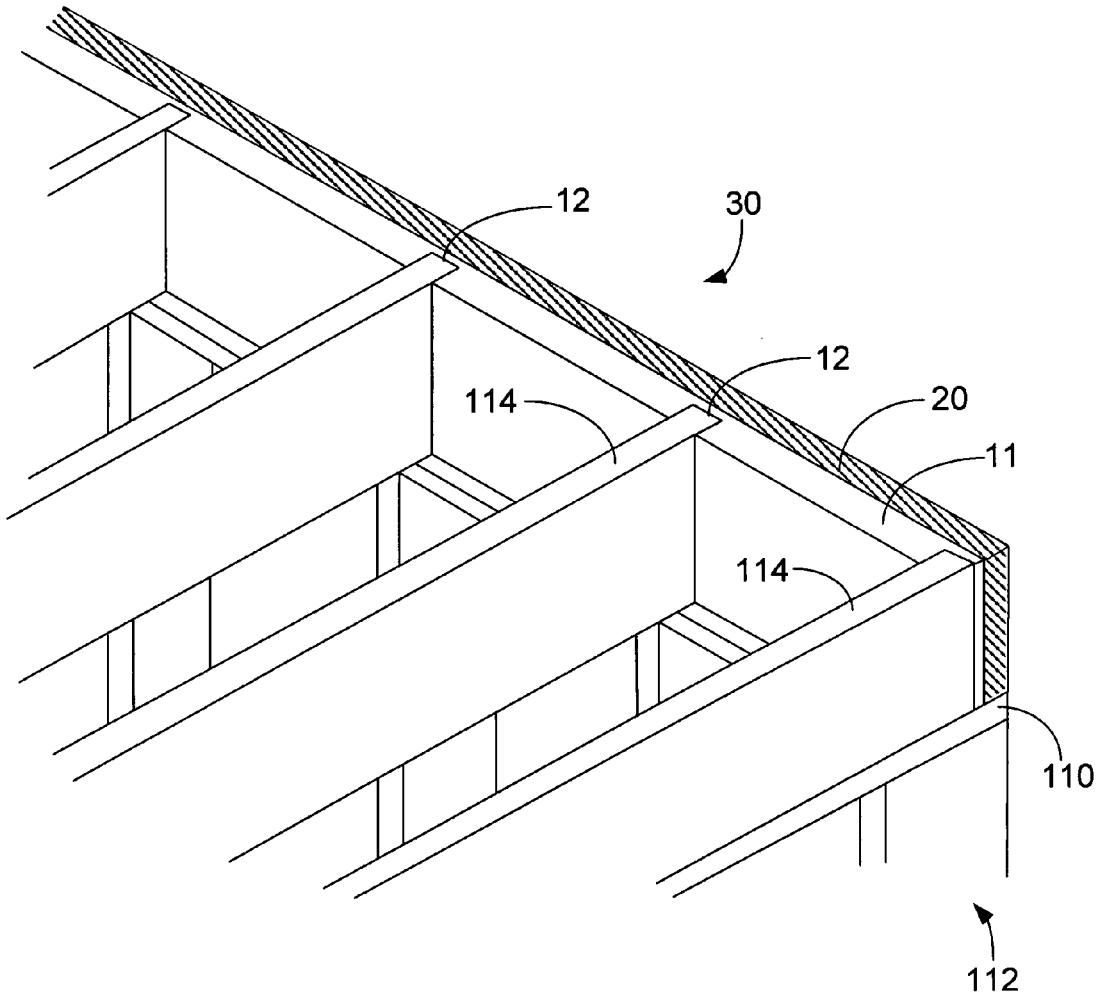
FIGS. 6 and 6A are partial perspective views of a rigid insulation product with and without a pre-mounted wood member, installed over the top plate of a wall.
Figure 6A:
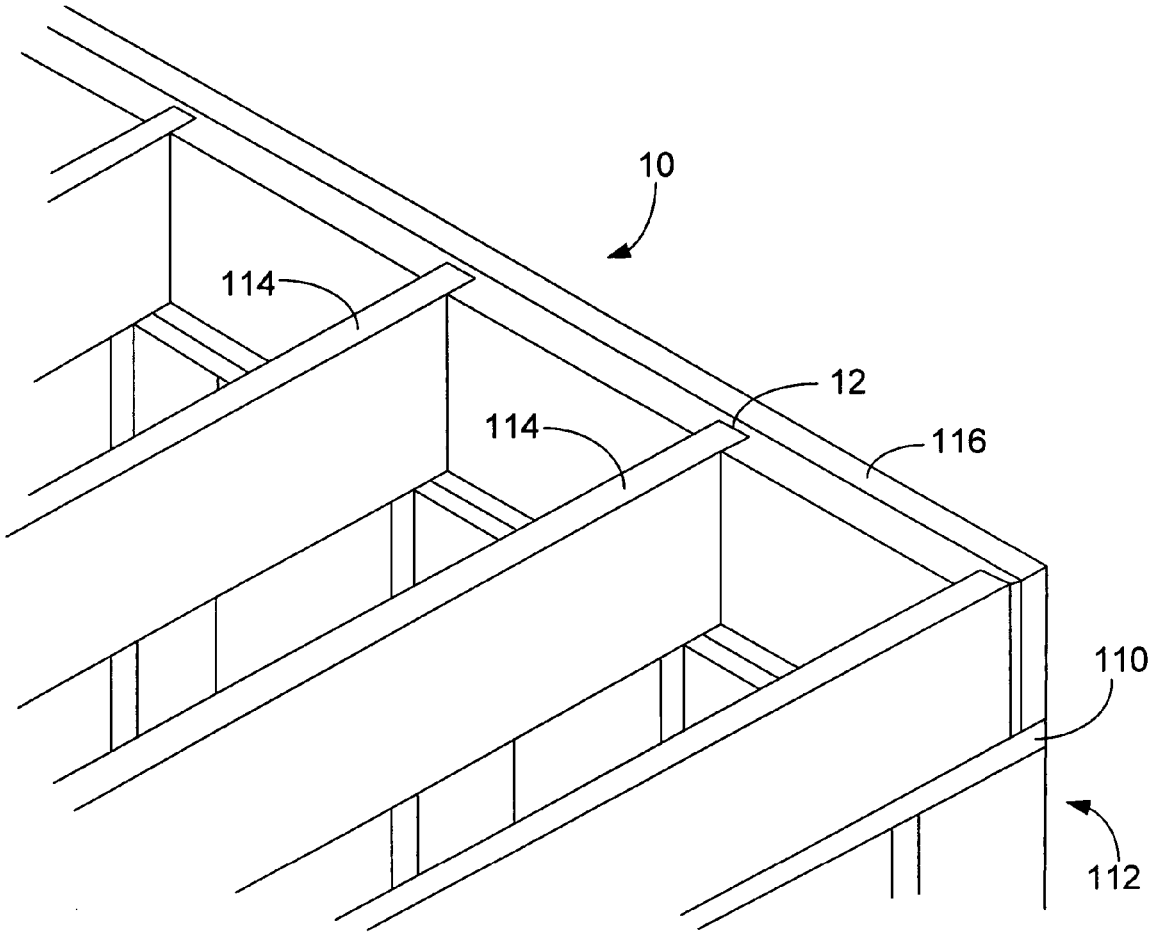

Additionally, while the rigid insulation products described above have been described in the context of floor framing, they can be used in other similar applications. For example, the rigid insulation products can be used over the top plate 110 of a wall 112, as shown in FIGS. 6 and 6A. As discussed above, the horizontally extending joists 114 are received by slots 12 in the rigid insulation product. In the embodiment shown in FIG. 6, the rigid insulation product 30 includes a pre-mounted wood member 20, while in the embodiment shown in FIG. 6A the rigid insulation product 10 is attached to a header 116 as discussed above.

Moreover, while the products described above are intended primarily for wood frame construction, they may be used, if desired, in structures that include a combination of wood framing and other materials, e.g., metal, composite, or other manufactured joists, or that are framed entirely of other materials.

Accordingly, other embodiments are within the scope of the following claims.

What is claimed is:

1. A rigid insulation product for use in wood frame construction, comprising a single unitary insulating member formed of a single rigid cellular insulating material having substantially uniform rigidity, dimensioned to be mounted lengthwise on a joist header and including a plurality of slots extending width-wise into the single rigid insulating material across one side of the member, each slot being dimensioned to receive an end of a floor joist, the member including a wall, at the base of each slot, having a thickness of at least about 0.375 inch and less than about 1.0 inch, and the member having a thickness, in regions between the slots, of from about 1.0 to about 3.0 inches.

2. The rigid insulation product of claim 1 wherein the member includes a wall, at the base of each slot, of sufficient thickness to provide a thermal break between a floor joist end and a joist header when the product is in use.

3. The rigid insulation product of claim 1 wherein the width of the insulating member is substantially equal to the width of a joist header on which the insulating member will be mounted.

4. The rigid insulation product of claim 1 wherein the slots extend across the entire width of the insulating member.

5. The rigid insulation product of claim 1 wherein the insulating member comprises an insulating material selected from the group consisting of cellular polystyrene, polyurethane and isocyanurate, other cellular plastics, and cellulose.

6. The rigid insulation product of claim 1 wherein at least some of the slots are dimensioned to receive an end of a wood I-beam.

7. The rigid insulation product of claim 1 wherein the slots are spaced at intervals of about 16 inches.

8. A rigid insulation product for use in wood frame construction, comprising:

a single unitary thermal insulating member comprising a rigid cellular insulating material having substantially uniform rigidity, including a plurality of slots extending width-wise across the member on a first side of the member, each slot being exposed to receive an end of a floor joist; and a wood member, configured so that the wood member will function as a joist header in a wood frame construction, bonded to the insulating member on a second side of the member opposite the first side.

9. The rigid insulation product of claim 8 wherein the slots are disposed at spaced intervals, the spacing of the slots corresponding to predetermined spacing of floor joists in a wood frame construction.

10. The rigid insulation product of claim 9 wherein the slots are spaced at intervals of about 16 inches.

11. The rigid insulation product of claim 8 wherein the insulating member includes a wall, at the base of each slot, of sufficient thickness to provide a thermal break between a floor joist end and a joist header when the product is in use.

12. The rigid insulation product of claim 11 wherein the wall has a thickness of at least 0.375 inch.

13. The rigid insulation product of claim 8 wherein the width of the insulating member is substantially equal to the width of the wood member.

14. The rigid insulation product of claim 8 wherein the slots extend across the entire width of the insulating member.

15. The rigid insulation product of claim 8 wherein the insulating member comprises an insulating material selected from the group consisting of cellular polystyrene, polyurethane and isocyanurate, other cellular plastics, and cellulose.

16. The rigid insulation product of claim 8 wherein at least some of the slots are dimensioned to receive an end of a wood I-beam.

17. The rigid insulation product of claim 8 wherein the insulating member has a thickness, in regions between the slots, of from about 1.0 to 3.5 inches.

* * * * *